US005895528A

United States Patent [19]

Gomariz Perez

[11] Patent Number: 5,895,528

[45] Date of Patent: Apr. 20, 1999

[54] REVARNISHER OF INCISIONS IN EASY-TO-OPEN CIRCULAR LIDS

[76] Inventor: Ana Maria Gomariz Perez, Mayor 14, 30500 Molina de Segura, Murcia, Spain

[21] Appl. No.: 08/804,126

[22] Filed: Feb. 20, 1997

[51] Int. Cl.[6] ..... B05B 13/02; B05C 13/00; B21D 51/46

[52] U.S. Cl. ..... 118/324; 413/61; 118/500

[58] Field of Search ..... 118/324, 300, 118/315, 500, 313, 663, 669; 198/471.1, 608; 413/58, 61

[56] References Cited

U.S. PATENT DOCUMENTS 3,712,450 1/1973 Hurst ..... 198/471.1

5,215,587 6/1993 McConnellogue et al. ..... 118/324

*Primary Examiner*—David A. Simmons

*Assistant Examiner*—Calvin Padgett

*Attorney, Agent, or Firm*—Robert M. Schwartz

[57] ABSTRACT

The improvements consists on the efficient collaboration of magnetic devices and a revarnishing device which allow the lids to pass at a high speed and round-the-clock trouble-free operation, on the basis of strips (8) which house magnets (9) which hold the lid (3) while it is being carried and stop for a few tenths of a second opposite a nozzle (4) of a easy-to-open incision revarnishing device spray gun (12).

3 Claims, 4 Drawing Sheets

REVARNISHER OF INCISIONS IN EASY-TO-OPEN CIRCULAR LIDS

BACKGROUND OF THE INVENTION

Varnishing of lids of cans and other easy-to-open type containers is quite well-known, very efficient and usually uses the devices of the type which comprise a mechanism that supplies varnished, means of feeding the cans to a revarnisher device and a drying kiln of the spray line deposited on the incision.

However, the working conditions, and the fact that work is performed continuously to avoid having to turn off the kiln, gives rise to different problems, the greatest of which is the positioning of the cans on the conveyor belt, which is solved by mechanical means, generally by means of a brake, solution which makes it difficult to increase the cans pass at a faster speed, unless the risk of deviating the spray jets is assumed.

To the knowledge of the applicant, there are no high-speed revarnishers that operate continuously with the collaboration of a very accurate magnetic lid positioning mechanism with another, pistol-based automatic circular revarnishing mechanism, within a conventional revarnished-lid intermittent transport mechanism.

SUMMARY OF THE INVENTION

This invention relates to a revarnisher of incisions in easy-to-open circular lids, which is of the type that conventionally comprises:

- a tower that magnetically supplies lids, that have been varnished and already have the easy-to-open incision, to
- a conveyor belt having intermittent movement, (stop-start movement), that directs the lids to the revarnisher and then to
- a tower-type vertical convector furnace, with a rotary lid transporter by means of conveyor buckets attached to a chain and in perfect timed relationship with the conveyor belt stop-start mechanism.

The furnace is used for continuous heat-drying the lids on the gun-deposited spray line, and it is also used for consecutive cooling of the lids, with the aid of an additional fan incorporated into the body of the furnace and previously located at the exit of the furnace from which the lids are come out.

The improvements object of this invention are related to the means that permits to revarnish with accuracy the incision of the lid, which it is supplied from the tower without varnish and unprotected.

This invention is characterized by the efficient collaboration of magnetic means that hold the lid while it is being transported, consisting of strips assembled parallel and at the sides of the conveyor belt, strips that are provided with lines having a large number of notches, for conventional housing of magnets, that hold the edges of the lid.

The lids are guided by ridges laterally located to the strips facilitating rigid and sway-free transport of the lid.

The magnets of each line generate circular magnetic fields, making it possible to hold and convey the lid without it moving, and perfectly positioning for a few tenths of a second, opposite the spray gun nozzles.

As it was related before, the conveyor belt has an intermittent movement, so that the conveyor belt stops to permits the lid to be hold by the magnets without it moving.

Together with the above mentioned, for such purposes of collaboration, the incision-revarnishing device allows the lids to pass at a high speed and round-the-clock trouble-free operation.

The device spray gun is attached at the end to a central longitudinal arm which is carried by a transverse bar that interconnect two eccentric discs.

The transverse bar is provided with downward projecting pins at its outer ends, which pins project in openings of the discs, said discs are secured to corresponding driven-cylinders that rotate performing an eccentrical movement.

The pins thereby follow a similar circular movement and as a result of the connection between the longitudinal arm and the gun, the gun will travel along a circular path that coincides with the circular incision on the lid.

Furthermore in another embodiment of the invention, the improvements of the revarnisher of incisions consist in that said spray gun is attached to the end of a transverse bar, whose other end is assembled on an eccentric disc secure to a corresponding driven-cylinder.

This revarnisher is assisted by conventional means for storing and feeding the varnish to the gun, a protective varnishing-station screen to avoid mishandling and sensors connected to automatic stop devices.

BRIEF DESCRIPTION OF THE DRAWINGS

A set of drawings have been enclosed with this descriptive report, of which they form an integral part, in order to supplement this description and make it easier to understand the characteristics of the invention. These drawings, which are provided for the purposes of illustration and are by no means of a limiting nature, show the following.

DESCRIPTION OF THE PREFERRED EMBODIMENT

Figure 1:
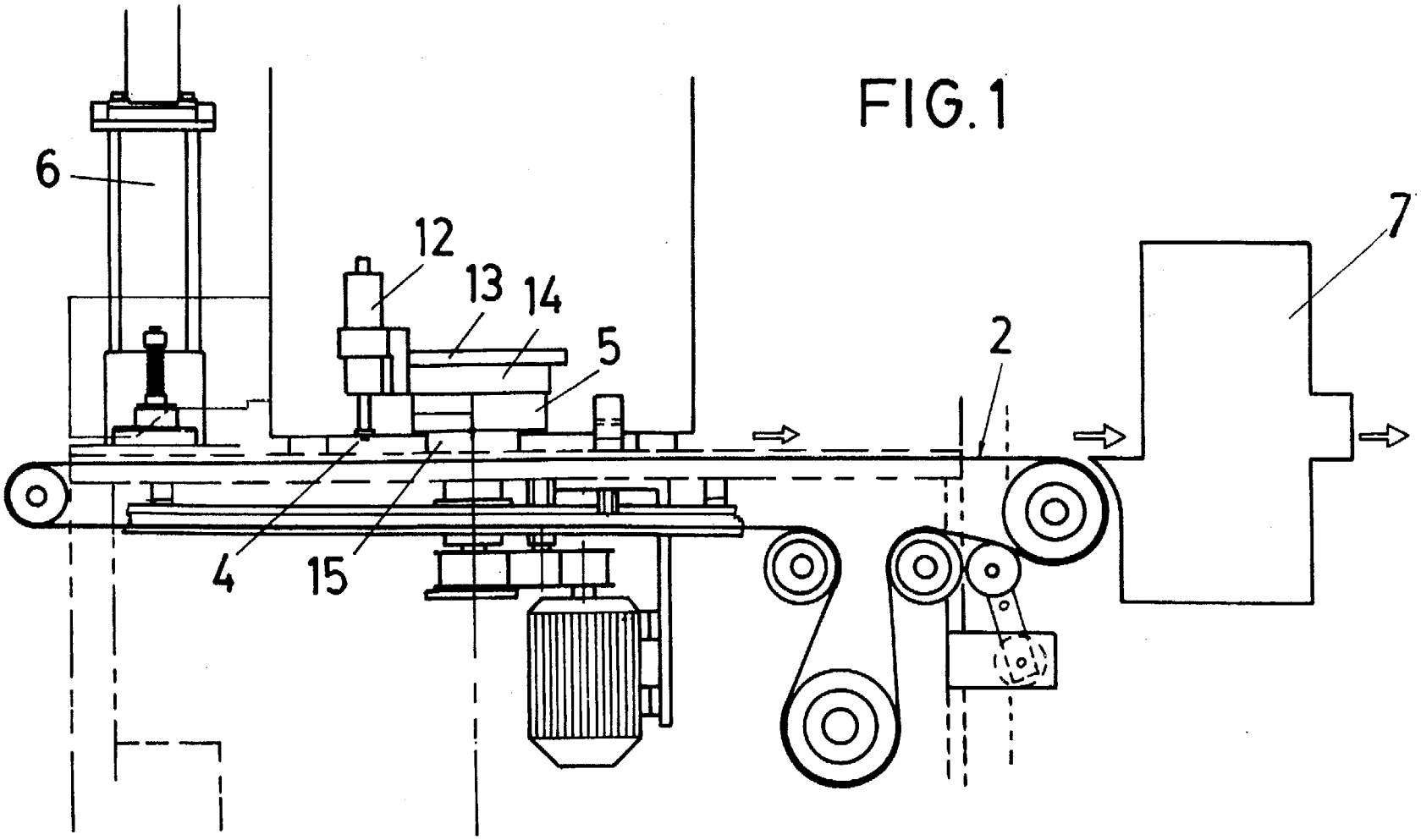
FIG. 1 is an elevation view of the revarnishing area, showing the lid-feeding tower, the lid conveyor belt and the magnetic lid-holding means, the gun support-bracket, the eccentric and its conventional operating devices.
Figure 2:
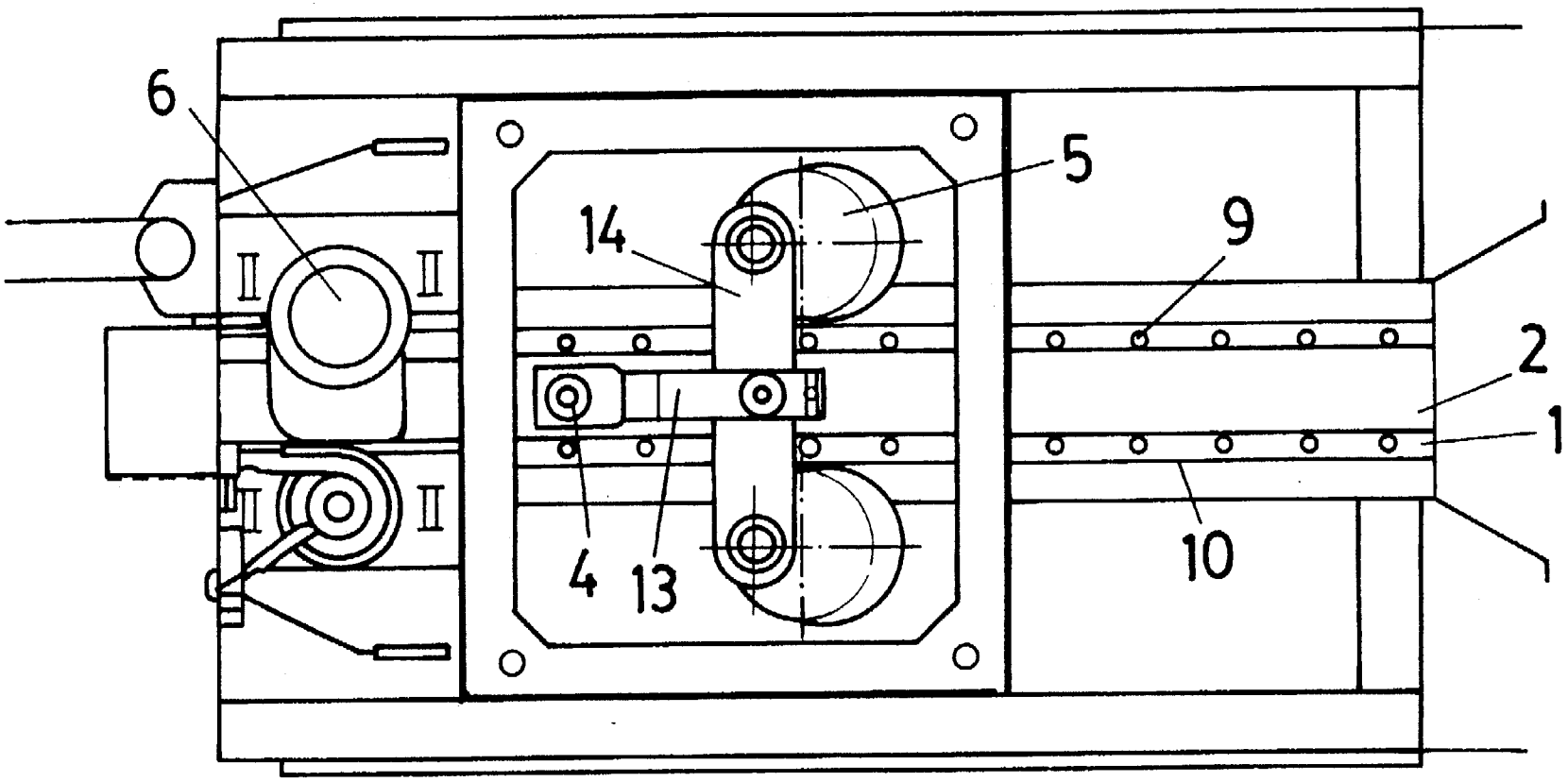
FIG. 2 is a fragmentary cross section of FIG. 1.
Figure 3:
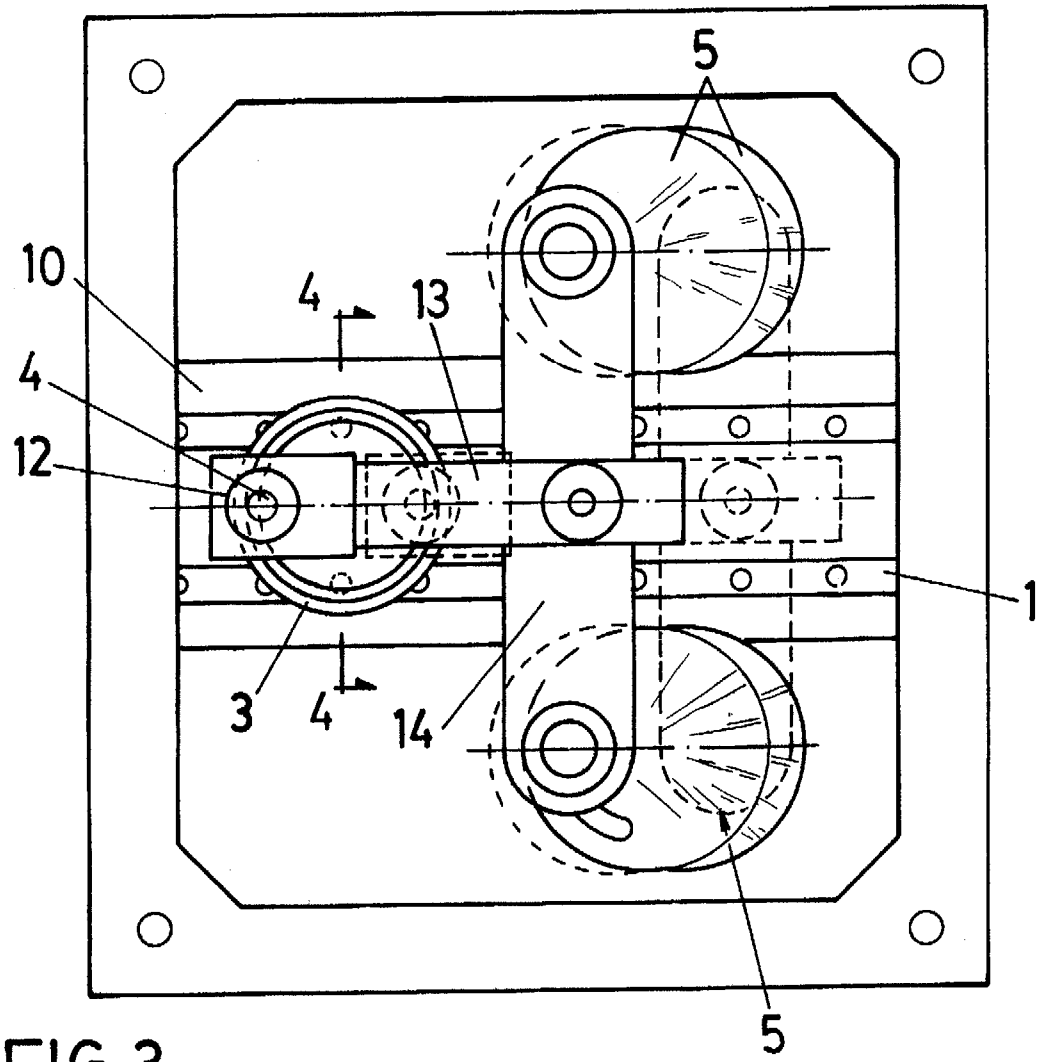
FIG. 3 is a plan view of the layout of the magnetic lid-holding means, in a fragmentary cross-section of the conveyor belt.
Figure 4:
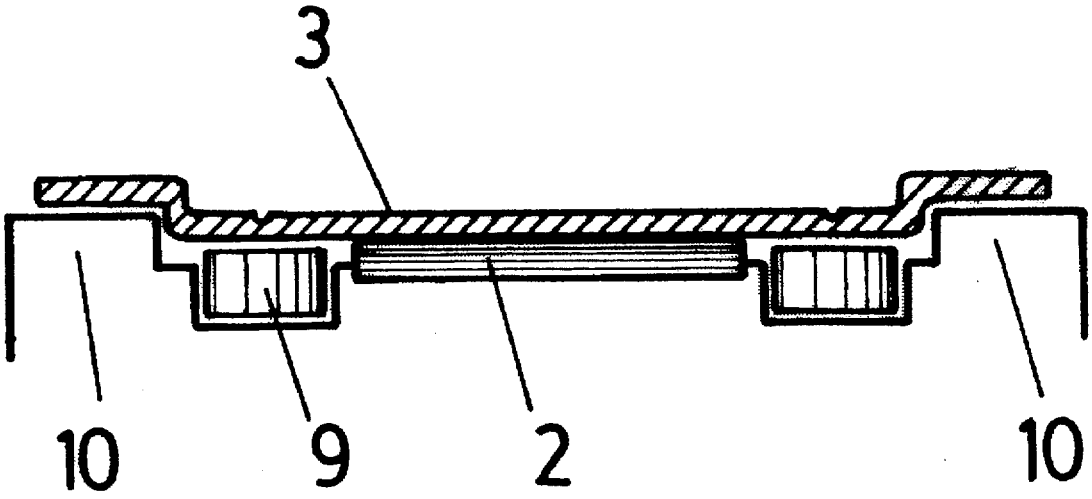
FIG. 4 is a front cross-section view of FIG. 3 over A—A.

As can be seen from the description given above, this invention relates to a revarnisher of incisions in easy-to-open circular lids, of the type which conventionally includes, a mechanism (6) that supplies the lids (3), an intermittently moving conveyor belt (2) that carry on the lids (3), an spray gun (12) with nozzles (4) for revarnishing of the incision, and a vertical convector furnace (7) for heat-drying.

The revarnisher of incisions in easy-to open circular lids is characterized by the efficient collaboration of magnetic means that hold the lid while it is being transported.

The improvements of the revarnisher of incisions comprises:

- two strips (1) assembled in parallel form and at the sides of said conveyor belt (2), and provided with a large number of notches (8), which house magnets (9) that hold the lid (3), providing a perfect positioning of the lid opposite to said spray gun (12),
- lateral ridges (10) that laterally guide the lid (3), facilitating rigid and sway-free transport of the lid.

Additionally the improvements of the revarnisher of incisions consists in that said spray gun (12) is attached at the end to a central longitudinal arm (14) which is carried by a transverse bar (13) that interconnects two eccentric discs (5), said discs (5) secure to a corresponding driven-cylinder (15)

whose rotatory movement provides said nozzle of said spray gun to describe the antagonistic circle of the lid incision.

A fuller description is not given because it is understood that any expert in this field will have enough information to understand the scope of the invention and its derived advantages, and to reproduce it.

It is understood that the materials, shape, size and layout of the parts are liable to change as long as no change is made to the essential features of the invention.

The terms used in the description and the sense thereof should always be considered to be of a non-limiting nature.

We claim:

1. Revarnisher of incisions in easy-to-open circular lids comprising:

a mechanism that supplies varnished circular lids with an easy-to-open circular incision without varnishing, a revarnishing device provided with a spray gun that revarnishes said easy-to-open circular incision by depositing a spray line on said incision, a drying kiln for heat-drying said lids on said spray line that was deposited on said incision, a conveyor belt with intermittent movement that directs said circular lids with an easy-to-open circular incision from said mechanism to the said spray gun of said revarnishing device and then to said drying kiln, two strips provided with notches one strip assembled in parallel form to the other strip at each side of said link chain, magnets housed in said notches generating a magnetic field to hold the lid without moving when the conveyor belt stops and the lid is positioned opposite said spray gun, and two ridges that guide the lids on the conveyor belt, said ridges are located laterally to said strips.

2. Revarnisher of incisions in easy-to-open circular lids according to claim 1, wherein said spray gun is attached at an end to a central longitudinal arm which is carried by a transverse bar, said transverse bar has two downward projecting pins at its outer ends, wherein said pins project into openings of corresponding rotary eccentric discs secured to driven-cylinders, said eccentric discs providing a circular path along which the gun travels, wherein said circular path coincides with the circular incision of the lid.

3. Revarnisher of incisions in easy-to-open circular lids according to claim 1, wherein said spray gun is attached at an end to a transverse bar, whose other end is attached to a rotatory eccentric disc secured to a corresponding driven-cylinder, said eccentric disc providing a circular path along which the gun travels wherein said circular path coincides with the circular incision of the lid.

* * * * *